US010518281B2

(12) United States Patent
Fujiwara

(10) Patent No.: US 10,518,281 B2
(45) Date of Patent: Dec. 31, 2019

(54) TRIGGER-TYPE EJECTOR

(71) Applicant: Kotaro Fujiwara, Tokyo (JP)

(72) Inventor: Kotaro Fujiwara, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 16/301,690

(22) PCT Filed: Apr. 10, 2017

(86) PCT No.: PCT/JP2017/014723
§ 371 (c)(1),
(2) Date: Nov. 14, 2018

(87) PCT Pub. No.: WO2017/208630
PCT Pub. Date: Dec. 7, 2017

(65) Prior Publication Data

US 2019/0176177 A1 Jun. 13, 2019

(30) Foreign Application Priority Data

May 31, 2016 (JP) ..... 2016-109481
May 31, 2016 (JP) ..... 2016-109482

(51) Int. Cl.
*B05B 11/00* (2006.01)
*B05B 1/00* (2006.01)
(Continued)

(52) U.S. Cl.
CPC ..... *B05B 11/3011* (2013.01); *B05B 1/02* (2013.01); *B05B 11/0029* (2013.01);
(Continued)

(58) Field of Classification Search
CPC ..... B05B 11/3011; B05B 11/00; B05B 1/02; B65D 83/00
(Continued)

(56) References Cited

U.S. PATENT DOCUMENTS 4,350,298 A * 9/1982 Tada ..... B05B 7/005 239/333
4,944,431 A * 7/1990 Blake ..... B05B 11/3002 222/276
(Continued)

FOREIGN PATENT DOCUMENTS

JP 2011-057294 A 3/2011
JP 4767666 B2 9/2011
(Continued)

OTHER PUBLICATIONS

Jun. 6, 2017 International Search Report issued in International Patent Application No. PCT/JP2017/014723.
(Continued)

*Primary Examiner* — Vishal Pancholi
(74) *Attorney, Agent, or Firm* — Oliff PLC

(57) ABSTRACT

A trigger-type ejector includes: a pressure storage chamber formed in a nozzle head and communicating with a flow path through a communication hole; a pressure storage plunger including a large-diameter pressure receiving portion opposite a small-diameter pressure receiving portion and being movable between a close position where an ejection hole is closed and an open position where the ejection hole is opened; and a biasing member disposed in the pressure storage chamber and biasing the pressure storage plunger toward the close position, the trigger-type ejector being configured such that, when a pressure of a liquid in the pressure storage chamber becomes equal to or greater than a predetermined value, the pressure storage plunger moves from the close position to the open position against a biasing force of the biasing member and thus a liquid in the pressure storage chamber is ejected from the ejection hole to the outside.

5 Claims, 8 Drawing Sheets

(51) Int. Cl.
*B65D 83/00* (2006.01)
*F04B 9/14* (2006.01)
*B05B 1/02* (2006.01)

(52) U.S. Cl.
CPC ..... *B05B 11/0067* (2013.01); *B05B 11/304* (2013.01); *B65D 83/00* (2013.01); *F04B 9/14* (2013.01); *B05B 11/0044* (2018.08); *B05B 11/3045* (2013.01); *B05B 11/3067* (2013.01); *B05B 11/3077* (2013.01)

(58) Field of Classification Search
USPC ..... 222/153.13, 380, 383.1, 385
See application file for complete search history.

(56) References Cited

U.S. PATENT DOCUMENTS 4,953,791 A * 9/1990 Tada ..... B05B 1/12 222/324
5,335,858 A * 8/1994 Dunning ..... B05B 1/3431 239/333
5,590,834 A * 1/1997 Foster ..... B05B 11/0005 239/333
6,036,112 A * 3/2000 Hunsicker ..... B05B 7/0031 239/333
6,669,061 B2 * 12/2003 Tada ..... B05B 11/0032 222/153.13
2012/0091229 A1 * 4/2012 Laidler ..... B05B 7/0037 239/330

FOREIGN PATENT DOCUMENTS

JP 2012-250137 A 12/2012
JP 2014-166624 A 9/2014
JP 2016-159929 A 9/2016
WO 2017/038564 A1 3/2017

OTHER PUBLICATIONS

Dec. 4, 2018 International Preliminary Report on Patentability issued in International Patent Application No. PCT/JP2017/014723.
Aug. 20, 2019 Office Action issued in the Japanese Patent Application 2016-109481.

* cited by examiner

TRIGGER-TYPE EJECTOR

TECHNICAL FIELD

The present disclosure relates to a trigger-type ejector having: an ejector body attached to a mouth of a container in which a liquid is contained and including a liquid flow path; a pump actuated by operation of a trigger and pumping the liquid in the container to the flow path; and a nozzle head attached to the ejector body by being continuous with an outlet of the flow path and ejecting a liquid pumped to the flow path to the outside, and in particular, relates to a pressure storage style trigger-type ejector configured to eject a liquid after a pressure thereof is raised to a predetermined pressure.

BACKGROUND

In a container that contains a liquid such as mold removing agent, detergent, paste for clothes, wax for home use, hairdressing, air freshener or the like, as an ejector attached to a mouth of the container, a trigger-type ejector has been frequently used in which a liquid contained in the container is ejected (jetted) to the outside by a pump actuated by operation of a trigger.

As such a trigger-type ejector, PTL1, for example, describes a pressure storage style trigger-type ejector having: an ejector body attached to a mouth of a container in which a liquid is contained and including a liquid flow path; a pump actuated by operation of a trigger and pumping a liquid in the container to the flow path; and a nozzle head attached to the ejector body by being continuous with an outlet of the flow path and ejecting a liquid pumped to the flow path to the outside. Further, in a pressure storage chamber defined and formed between the ejector body and the nozzle head, a pressure storage plunger having a large-diameter pressure receiving portion in abutment with a large-diameter tubular portion and a small-diameter pressure receiving portion in abutment with a small-diameter tubular portion and a biasing member (spring) biasing the pressure storage plunger toward a close position where an ejection hole is closed are disposed. According to the above described pressure storage style trigger-type ejector, when a liquid pressure in the pressure storage chamber becomes equal to or greater than a predetermined value, the pressure storage plunger opens against a biasing force of the biasing member due to a difference in the cross-sectional areas between the large-diameter pressure receiving portion and the small-diameter pressure receiving portion, and thus the liquid can be ejected at a high pressure.

CITATION LIST

Patent Literature

PTL 1: JP4767666 (B2)

SUMMARY

Technical Problem

However, in the above described conventional trigger-type ejector, the pressure storage chamber is defined and formed between the ejector body and the nozzle head by assembling the nozzle head to the ejector body. Thus the pressure storage plunger and the biasing member to be assembled to the pressure storage chamber cannot be held in the pressure storage chamber until the nozzle head is assembled to the ejector body, which requires all of these members to be assembled to the ejector body with a consistent line, and thus complicates the assembly work.

Further, as for a trigger-type ejector, one having the above-described basic configuration of a pressure storage-type and is configured to foam a liquid with a foaming portion provided at the tip of the nozzle head and to eject (jet) the liquid to the outside has been known. As for such a trigger-type ejector, an open-close type lid body is provided at the tip of the nozzle head and an ejection hole of the nozzle head is closed by the lid body, which makes the ejector in an ejection incapable state and prevents the liquid from being accidentally ejected when not in use.

However, with the configuration in which the ejection hole is closed by the lid body provided at the tip of the nozzle head, a liquid ejected from the ejection hole may attach to the lid body and then may attach to a finger or the like that opens or closes the lid body. Further, a small lid body is not easy to be handled, and thus an operation to switch the trigger-type ejector into an ejection incapable state is complex.

The present disclosure has been conceived in view of the above problem, and is to provide a trigger-type ejector that enables easy assembly of a nozzle head including a pressure storage plunger and a biasing member to an ejector body.

The present disclosure is to provide also a trigger-type ejector that can be switched to an ejection incapable state without liquid attached to a finger or the like.

Solution to Problem

The disclosed trigger-type ejector is a trigger-type ejector having: an ejector body attached to a mouth of a container in which a liquid is contained and including a flow path of a liquid; a pump actuated by operation of a trigger and pumping the liquid in the container to the flow path; and a nozzle head attached to the ejector body by being continuous with an outlet of the flow path and ejecting a liquid pumped to the flow path from an ejection hole to the outside, the trigger-type ejector including: a pressure storage chamber defined and formed in the nozzle head and communicating with the flow path through a communication hole; a pressure storage plunger including a large-diameter pressure receiving portion and a small-diameter pressure receiving portion facing the opposite side to the large-diameter pressure receiving portion, the pressure storage plunger being disposed in the pressure storage chamber and being movable between a close position where the ejection hole is closed and an open position where the ejection hole is opened; and a biasing member disposed in the pressure storage chamber and biasing the pressure storage plunger toward the close position, wherein, when the pressure of a liquid in the pressure storage chamber becomes equal to or greater than a predetermined value, the pressure storage plunger moves from the close position to the open position against a biasing force of the biasing member such that the liquid in the pressure storage chamber is ejected from the ejection hole to the outside.

In the disclosed trigger-type ejector configured in the above described manner, preferably, the nozzle head includes a first nozzle body provided with the ejection hole and a second nozzle body fixed to the first nozzle body, the second nozzle body defining and forming the pressure storage chamber with the first nozzle body and including the communication hole, and the nozzle head is attached to the ejector body at the second nozzle body.

In the disclosed trigger-type ejector configured in the above described manner, preferably, the trigger-type ejector further includes a nozzle chip. The nozzle chip is provided with a small hole whose cross-sectional area is smaller than that of the ejection hole and is attached to the ejection hole so as to atomize a liquid ejected from the ejection hole.

In the disclosed trigger-type ejector configured in the above described manner, preferably, the second nozzle body includes an inner cylinder wall surrounding the communication hole and including, in an inner periphery, at least one rear groove communicating with an outlet of the flow path; the ejector body includes a column disposed inside the inner cylinder wall in a rotatable and liquid-tight manner relative to the inner cylinder wall and provided with, in an outer periphery, at least one front groove communicating with the communication hole; and the nozzle head is rotatable relative to the ejector body between an ejection capable position where the rear groove and the front groove communicate with each other and an ejection incapable position where the communication between the rear groove and the front groove is blocked.

In the disclosed trigger-type ejector configured in the above described manner, preferably, the trigger-type ejector further has a foaming portion provided in the ejection hole and foaming a liquid ejected from the ejection hole; the nozzle head includes an inner cylinder wall surrounding the communication hole and provided with, in an inner periphery, at least one rear groove communicating with the outlet of the flow path; and the ejector body includes a column disposed inside the inner cylinder wall in a rotatable and liquid-tight manner relative to the inner cylinder wall and provided with, in an outer periphery, at least one front groove communicating with the communication hole, and as a result thereof, the nozzle head is rotatable relative to the ejector body between an ejection capable position where the rear groove and the front groove communicate with each other and an ejection incapable position where the communication between the rear groove and the front groove is blocked.

Advantageous Effect

According to the present disclosure, a nozzle head can be unitized in advance by disposing a pressure storage plunger and a biasing member in a pressure storage chamber defined and formed by fixing a second nozzle body to a first nozzle body. Thus, a nozzle head including a pressure storage plunger and a biasing member can be easily assembled to an ejector body.

In this manner, according to the present disclosure, a trigger-type ejector that enables easy assembly of a nozzle head including a pressure storage plunger and a biasing member to an ejector body can be provided.

Further, according to the present disclosure, a trigger-type ejector can be easily switched to an ejection incapable state by a simple operation in which a nozzle head is just rotated from an ejection capable position to an ejection incapable position without liquid attached to a finger or the like.

In this manner, according to the present disclosure, a trigger-type ejector that allows for easy switching to an ejection incapable state without a liquid attached to a finger or the like can be provided.

DETAILED DESCRIPTION

A trigger-type ejector 1 according to an embodiment of the present disclosure will be described in detail below with reference to drawings.

Figure 1:
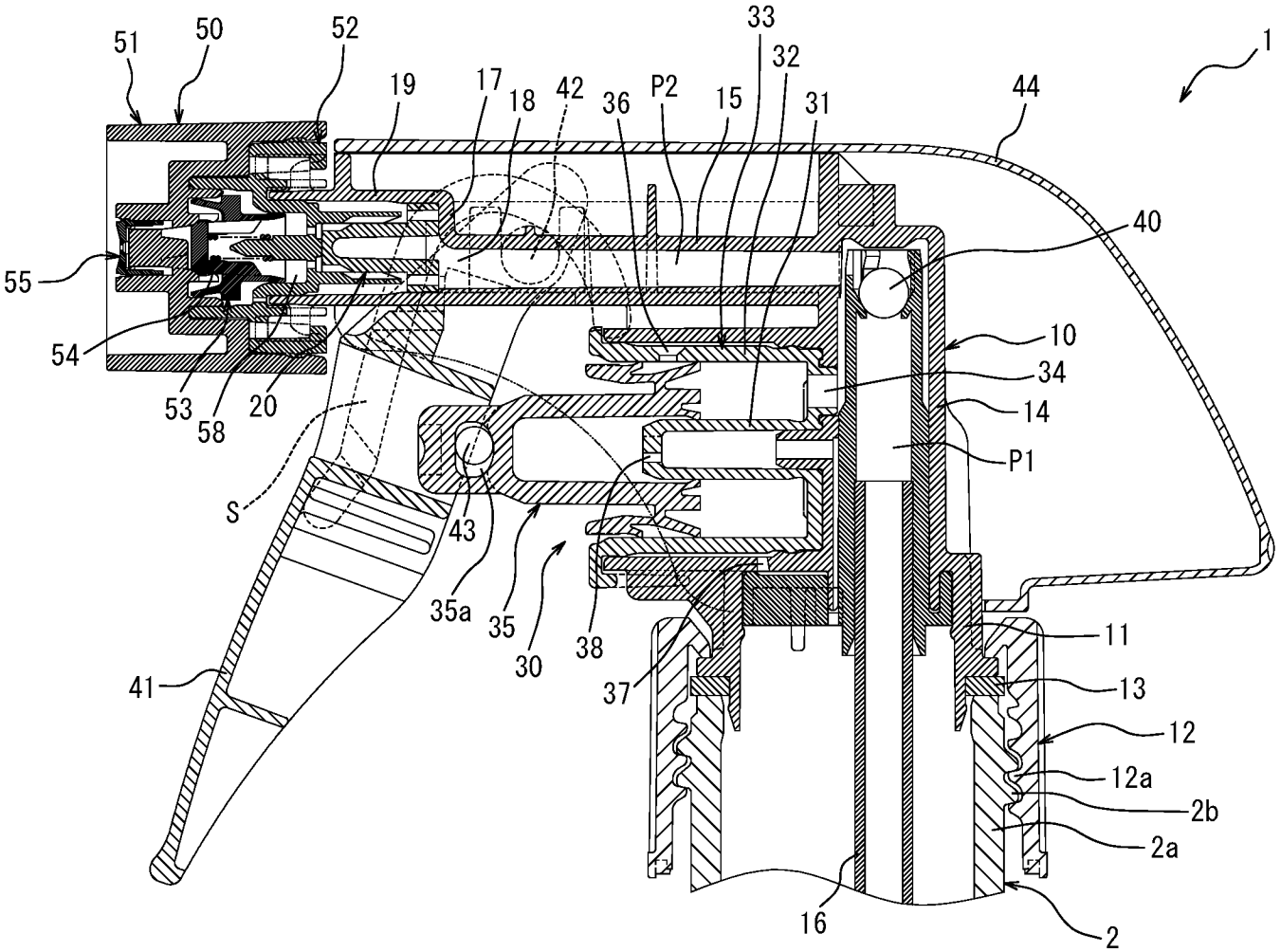
FIG. 1 is a cross-sectional diagram (longitudinal cross-sectional diagram) of a trigger-type ejector viewed from a side according to an embodiment of the present disclosure.

In the present specification, the scope of claims and the abstract, the side where a shroud 44 is located relative to the mounting cap 12 is defined as an upside (the upper side in FIG. 1) and the opposite side thereof is defined as a downside (the lower side in FIG. 1). Further, the side where a trigger 41 is located relative to a piston 35 of a pump 30 is defined as a front side (the left side in FIG. 1) and the opposite side thereof is defined as a rear side (the right side in FIG. 1).

The trigger-type ejector 1 of an embodiment of the present disclosure illustrated in FIG. 1 is attached to a mouth 2*a* of a container 2 that contains a liquid as a content liquid when used. FIG. 1 illustrates a state where the trigger-type ejector 1 is attached to the mouth 2*a* of the container 2.

The trigger-type ejector 1 includes an ejector body 10 that is attached to the mouth 2*a*. The ejector body 10 may be made of synthetic resin, for example. The lower end of the ejector body 10 is provided with a coupling tube 11, to which a mounting cap 12 is attached such that it is rotatable relative to the coupling tube 11. The mounting cap 12 is formed into a cylindrical shape with an inner diameter corresponding to an outer diameter of the mouth 2*a*, and the ejector body 10 can be fixed to the mouth 2*a* by screwing an external thread 2*b* provided in the outer periphery of the mouth 2*a* into an internal thread 12*a* provided in the inner periphery of the mounting cap 12 with the coupling tube 11 fitted into the inner periphery of the mouth 2*a*. It is to be noted that the reference sign 13 indicates a sealing member such as packing that seals between the mouth 2*a* and the coupling tube 11.

The ejector body 10 includes a cylindrical standing portion 14 extending from the coupling tube 11 in the direction along a central axis thereof and a cylindrical extending portion 15 extending orthogonal to the standing portion 14. Inside the standing portion 14 is provided with a standing flow path P1 that reaches the coupling tube 11, and a tube 16 for suction inserted into the container 2 is connected to the standing flow path P1. On the other hand, the extending portion 15 is provided with an extending flow path P2 that extends orthogonal to the standing flow path P1. A liquid flow path is formed in the ejector body 10 by the standing flow path P1 and the extending flow path P2.

A plate wall 17 is integrally provided at the front end of the extending portion 15, and an outlet 18 of the extending flow path P2 opens in the plate wall 17. Further, the plate wall 17 is integrally provided with an annular wall 19 formed into a tubular shape with a diameter larger than that of the outlet 18 and protruding forward from the plate wall 17.

Figure 2:
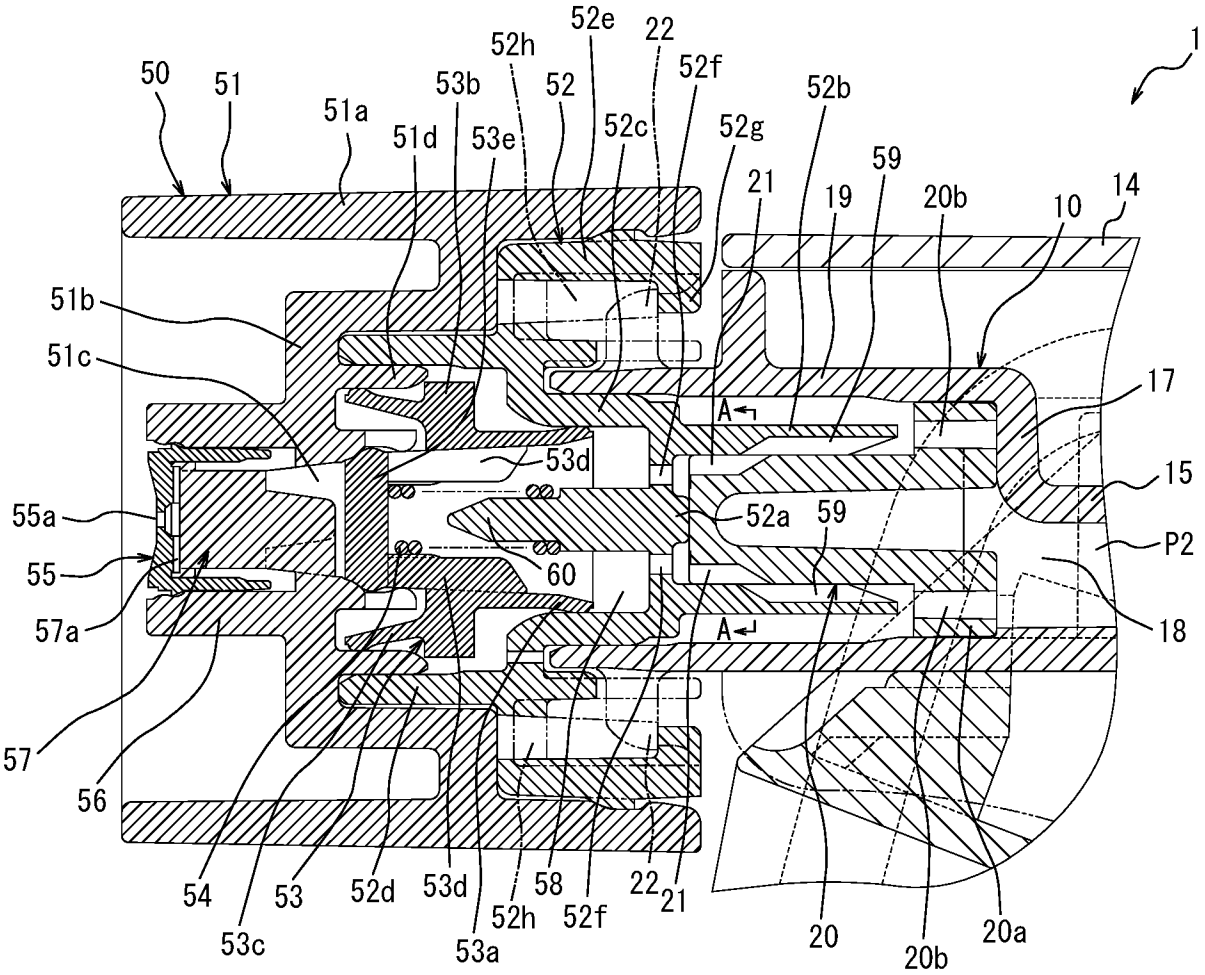
FIG. 2 is an enlarged cross-sectional diagram of a nozzle head of the trigger-type ejector illustrated in FIG. 1.

Inside the annular wall 19 is provided with a column 20 coaxially with the annular wall 19. As illustrated in FIG. 2, the column 20 is formed separately from the plate wall 17 and the annular wall 19, and is fitted into the inside of the annular wall 19 at a large-diameter base end 20*a* thereof. It is to be noted that the column 20 may also be integrally formed in the plate wall 17 and the annular wall 19. The column 20, along with the outlet 18, is surrounded by the annular wall 19. Further, the large-diameter base end 20*a* of the column 20 is provided with a plurality of through holes 20*b*, and the outlet 18 of the extending flow path P2 is communicated with an open end side of the annular wall 19 through these through holes 20*b*.

Further, the outer periphery of the column 20 is provided with a front groove 21 extending from a tip (front side end) to backward thereof. The front groove 21 is opened to the front and the side of the column 20, and two of them in total are disposed opposed to each other across the central axis of the column 20. These front grooves 21 communicate with a communication hole 52*f* provided in a second nozzle body 52 described later. It is to be noted that, although two front grooves 21 are provided in the outer periphery of the column 20 in the present embodiment, the number can be appropriately changed as far as at least one front groove 21 is provided.

A pair of outward claws 22 protruded radially outward is integrally provided on the outer periphery of a part of a tip side (front end side) of the annular wall 19.

As illustrated in FIG. 1, the trigger-type ejector 1 includes the pump 30. The pump 30 has a cylinder 33 including an inner cylinder 31 and an outer cylinder 32 and attached to the ejector body 10. The cylinder 33 is provided with an inflow/outflow hole 34, and the inside of the cylinder 33 communicates with the standing flow path P1 and the extending flow path P2 through the inflow/outflow hole 34.

The piston 35 is movably attached between the inner cylinder 31 and the outer cylinder 32 in the direction along the central axis of the cylinder 33. The inner peripheral portion of the piston 35 is in abutment with the outer periphery of the inner cylinder 31 in a slidable and liquid-tight manner, and the outer peripheral portion of the piston 35 is in abutment with the inner periphery of the outer cylinder 32 in a slidable and liquid-tight manner.

The outer cylinder 32 is provided with an air intake hole 36 that is exposed to the outside when a trigger 41 described later is pulled and thus the piston 35 moves to the stroke end. Further, the ejector body 10 is provided with an air vent hole 37 that allows the inside of the container 2 and the air intake hole 36 to communicate with each other. Thus, when the pump 30 is actuated and the liquid in the container 2 is ejected, the outside air is taken into the container 2 through the intake hole 36 and the air vent hole 37 and is replaced with the liquid in the container 2. Further, a space inside the piston 35 communicates with the inside of the container 2 through an opening 38 provided at the tip of the inner cylinder 31.

The standing flow path P1 is provided with a ball-like check valve 40. The check valve 40 allows for a liquid flow from inside of the container 2 toward the inflow/outflow hole 34 and, on the other hand, prevents a liquid discharged from the inflow/outflow hole 34 due to actuation of the pump 30 from flowing to the container 2 through the standing flow path P1. It is to be noted that the check valve 40 is not limited to a ball-like check valve, and a variety of check valves such as those formed into an umbrella shape whose outer peripheral edge comes in abutment with an inner periphery of the standing flow path P1 by an elastic body, for example, may be used.

The trigger (operation lever) 41 is attached to the ejector body 10. The trigger 41, on one end side thereof, is swingably supported by the ejector body 10 through a pivot 42. The middle portion of the trigger 41 is provided with a pin member 43, which engages with a recess 35*a* provided at the front side end portion of the piston 35. Further, a tip of a curved plate spring S whose base end is fixed to and held by the ejector body 10 is locked to the trigger 41. The trigger 41 is biased in the direction away from the pump 30 (in FIG. 1, in the clockwise direction about the pivot 42) by the plate spring S.

When the trigger 41 is pulled such that it rotates toward the pump 30, the liquid pressure in the cylinder 33 is raised by the piston 35, the check valve 40 is closed, and thus the liquid in the cylinder 33 is pumped from the inflow/outflow hole 34 to the extending flow path P2. On the other hand, when operation of the trigger 41 is canceled, the trigger 41 returns to the initial position by an elastic force of the plate spring S. Further, the check valve 40 opens along with the return operation, and the liquid in the container 2 is sucked from the inflow/outflow hole 34 into the cylinder 33 through the tube 16 and the standing flow path P1. Repetition of such pulling operation and canceling operation of the trigger 41 allows the liquid in the container 2 to be sucked through the standing flow path P1 and to be pumped to the outlet 18 through the extending flow path P2 through the actuation of the pump 30.

It is to be noted that the trigger 41 is not limited to those swingably supported by the ejector body 10, and it may be those moving linearly with the piston 35 as far as the piston 35 can be actuated by a pulling operation.

The shroud 44 covering almost all portions of the ejector body 10 and the pump 30 is attached to the ejector body 10. The trigger 41 protrudes from under the shroud 44 and can swing without interfering the shroud 44.

The nozzle head 50 is attached to the front end of the extending portion 15 of the ejector body 10, the nozzle head 50 being continuous with the outlet 18 of the extending flow path P2. The nozzle head 50 is adapted to include the first nozzle body 51, the second nozzle body 52, the pressure storage plunger 53, the biasing member 54 and a nozzle chip 55, and ejects (jets) a liquid to the outside, the liquid being pumped by the pump 30 to the outlet 18 through the standing flow path P1 and the extending flow path P2.

As illustrated in FIG. 2, the first nozzle body 51 includes an outer shell wall 51*a* of a substantially angular cylindrical shape. Inside the outer shell wall 51*a* is integrally provided with a partition wall 51*b* that divides the inner space of the outer shell wall 51*a* into a front side and a rear side, and the axial center of the partition wall 51*b* is provided with an ejection hole 51*c* for liquid. Further, the partition wall 51*b* is integrally provided with a large-diameter cylinder portion 51*d* protruding from the partition wall 51*b* toward the rear side.

The partition wall 51*b* is integrally provided with a projection cylinder 56 that protrudes forward from the partition wall 51*b* and communicates with the ejection hole 51*c*, and the nozzle chip 55 is fitted and fixed to the inside of the projection cylinder 56. The nozzle chip 55 includes, on the tip side thereof, a small hole 55*a* whose opening cross-sectional area is smaller than that of the ejection hole 51*c*, and this small hole 55*a* communicates with the ejection hole 51*c* through a passage provided between a spin groove 57*a* provided in a tip face of a spin element 57 disposed inside the projection cylinder 56 and a side of the spin element 57. The liquid ejected from the ejection hole 51*c* passes through the small hole 55*a* of the nozzle chip 55 through the spin groove 57*a*, and thus is atomized by the nozzle chip 55 and is ejected to the outside.

It is to be noted that, in the present embodiment, although the nozzle chip 55 is attached to the projection cylinder 56, that is, the ejection hole 51*c*, the nozzle chip 55 may not be attached to the ejection hole 51*c*. In this case, the partition wall 51*b* may not be provided with the projection cylinder 56.

The second nozzle body 52 includes a plate-like base 52*a* that is provided in front of the column 20 when the nozzle head 50 is attached to the ejector body 10. The base 52*a* is integrally provided with a cylindrical inner cylinder wall 52*b* extending backward. The inner cylinder wall 52*b* is disposed outside the column 20 and is, on the inner periphery thereof, in abutment with the outer periphery of the column 20 in a rotatable and liquid-tight manner. Further, the outer peripheral edge of the base 52*a* is integrally provided with a small-diameter cylinder portion 52*c* extending forward.

The front side of the small-diameter cylinder portion 52*c* is integrally provided with a cylindrical seal cylinder portion 52*d* whose diameter is larger than that of the small-diameter cylinder portion 52*c*, and the seal cylinder portion 52*d* is fitted to the outside of the large-diameter cylinder portion 51*d* of the first nozzle body 51 in a liquid-tight manner. Thus the pressure storage chamber 58 is defined and formed between the first nozzle body 51 and the second nozzle body 52. Further, the radial outside of the small-diameter cylinder portion 52*c* is integrally provided with a fixed cylinder portion 52*e* of a substantially angular cylindrical shape that corresponds to the outer shell wall 51*a*. The fixed cylinder portion 52*e* is engaged with the inside of the outer shell wall 51*a* in an undercut manner. In this manner the first nozzle body 51 and the second nozzle body 52 are fixed to each other, and the pressure storage chamber 58 is defined and formed between the first nozzle body 51 and the second nozzle body 52 that are fixed to each other.

The base 52*a* of the second nozzle body 52 is provided with a plurality of communication holes 52*f*. These communication holes 52*f* are surrounded by the inner cylinder wall 52*b*, and allows the pressure storage chamber 58 to communicate with the outlet 18 of the extending flow path P2 through the inside of the inner cylinder wall 52*b*. Further, the inner periphery of the inner cylinder wall 52*b* is provided with a rear groove 59 that extends forward from the rear end thereof to the position where it overlaps with the front groove 21 and communicates with the outlet 18 of the extending flow path P2. The rear groove 59 is opened to the back and the side of the inner cylinder wall 52*b*, and two in total are disposed opposed to each other across the central axis of the inner cylinder wall 52*b*. It is to be noted that, in the present embodiment, although two rear grooves 59 are provided in the inner periphery of the inner cylinder wall 52*b* in accordance with the front groove 21, the number can be appropriately changed in accordance with the front groove 21 as far as at least one rear groove 59 is provided.

The inner cylinder wall 52*b* of the second nozzle body 52 is rotatably supported by the column 20 provided at the ejector body 10, and the small-diameter cylinder portion 52*c* is rotatably supported by the annular wall 19. Thus the nozzle head 50 is rotatable relative to the ejector body 10. Further, the nozzle head 50 is prevented from being fallen out from the ejector body 10 through the engagement of a locking flange 52*g* provided at the fixed cylinder portion 52*e* of the second nozzle body 52 with the outward claw 22 provided at the annular wall 19. In this manner, the nozzle head 50 is attached to the ejector body 10 by the second nozzle body 52.

The rotating range of the nozzle head 50 relative to the ejector body 10 is defined as a range of about 90 degrees by allowing a pair of stopper pieces 52*h* provided inside the fixed cylinder portion 52*e* to be in abutment with the outward claw 22.

Figure 3A:
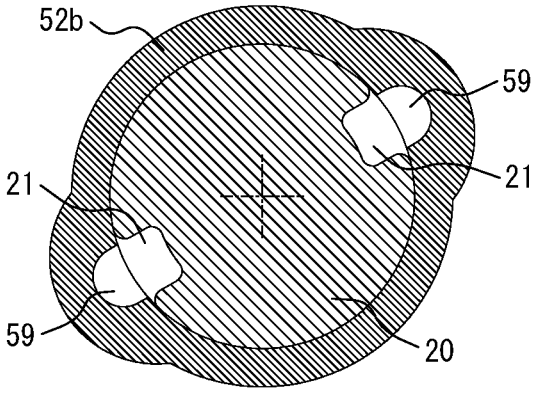
FIG. 3A is a cross-sectional diagram along A-A line in FIG. 2.
Figure 3B:
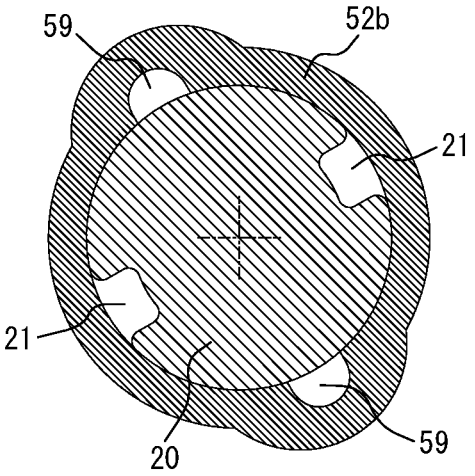
FIG. 3B is a cross-sectional diagram illustrating a state where the nozzle head is rotated from a state illustrated in FIG. 3A.

When the nozzle head 50 is put in a stroke end position of one of the rotating directions, that is, an ejection capable position, as illustrated in FIG. 3A, the rear groove 59 provided in the inner cylinder wall 52*b* and the front groove 21 provided in the column 20 are communicated with each other, and the extending flow path P2 is communicated with the communication hole 52*f*, that is, the pressure storage chamber 58, through the rear groove 59 and the front groove 21. In other words, when the nozzle head 50 is put in the ejection capable position, the trigger-type ejector 1 can be put into a liquid ejection capable state. On the other hand, when the nozzle head 50 is put in the stroke end position of the other rotating direction, that is, an ejection incapable position, as illustrated in FIG. 3B, the communication between the rear groove 59 and the front groove 21 is blocked, and the extending flow path P2 is put in a state where communication is blocked with respect to the communication hole 52*f*, that is, the pressure storage chamber 58. In other words, when the nozzle head 50 is put in the ejection incapable position, the trigger-type ejector 1 can be put in a state where it cannot eject a liquid.

As illustrated in FIG. 2, the pressure storage plunger 53 is disposed in the pressure storage chamber 58. The pressure storage plunger 53 includes a guide cylinder portion 53*a* in abutment with the inner periphery of the small-diameter cylinder portion 52*c* in a slidable and liquid-tight manner, a disc-shaped body 53*b* coupled to the front end of the guide cylinder portion 53*a*, and a large-diameter pressure receiving portion 53*c* extending forward from the body 53*b* in a diameter expanding manner and being in abutment with the inner periphery of the large-diameter cylinder portion 51*d* in a slidable and liquid-tight manner. Further, a substantially disc-shaped valve body 53*e* coupled to the large-diameter pressure receiving portion 53*c* by a plurality of legs 53*d* disposed circumferentially at intervals is integrally provided radially inside the large-diameter pressure receiving portion 53*c*. The valve body 53*e* constitutes a small-diameter pressure receiving portion facing the opposite side to the large-diameter pressure receiving portion 53.

Inside the pressure storage chamber 58, the pressure storage plunger 53 is movable between a close position (stroke end position of the front side) where the valve body 53*e* is in abutment with the ejection hole 51*c* and closes the ejection hole 51*c* and an open position (stroke end position of the rear side) where the valve body 53*e* moves backward from the close position and opens the ejection hole 51*c*.

The biasing member 54 is disposed in the pressure storage chamber 58 and biases the pressure storage plunger 53 toward the close position, that is, to the front side. More specifically, the biasing member 54 is formed of a coil spring, one end thereof being supported by a rod 60 integrally provided at the base 52*a* and the other end thereof being in abutment with the valve body 53*e*. Thus the biasing member 54 applies a biasing force (elastic force) that directs to the close position to the pressure storage plunger 53. In the present embodiment, although a coil spring is used as the biasing member 54, various types can be used as far as they can apply a biasing force that directs to the close position to the pressure storage plunger 53.

When the trigger 41 is operated with the nozzle head 50 put in the ejection capable position and the liquid in the container 2 is pumped by the pump 30 to the standing flow path P1 and the extending flow path P2, the liquid flown out from the outlet 18 is introduced from the communication hole 52*f* into the pressure storage chamber 58. When the liquid is introduced into the pressure storage chamber 58, the large-diameter pressure receiving portion 53*c* and the valve body 53*e*, which is the small-diameter pressure receiving portion, of the pressure storage plunger 53, receive a pressure of the liquid, and thus a force directing backward (a force directing from the close position to the open position) is generated at the pressure storage plunger 53 corresponding to the difference of the cross sectional areas between the large-diameter pressure receiving portion 53*c* and the small-diameter pressure receiving portion (valve body) 53*e*. Further, when the pressure of the liquid in the pressure storage chamber 58 becomes equal to or greater than a predetermined value, the force directing backward generated at the pressure storage plunger 53 corresponding to the difference of the cross-sectional areas between the large-diameter pressure receiving portion 53*c* and the valve body 53*e*, that is, the small-diameter pressure receiving portion, exceeds the biasing force of the biasing member 54. As a result of this, the pressure storage plunger 53 moves from the close position to the open position against the biasing force of the biasing member 54, and the ejection hole 51*c* is opened. In other words, when the pressure of the liquid in the pressure storage chamber 58 becomes equal to or greater than the predetermined valve, the pressure storage plunger 53 moves to the open position and the ejection hole 51*c* is opened. Thus, the liquid whose pressure is raised to the predetermined pressure is ejected from the ejection hole 51*c*, and at the same time the liquid ejected from the ejection hole 51*c* is atomized by the nozzle chip 55 and is ejected to the outside.

On the other hand, when the nozzle head 50 is rotated 90 degrees from the ejection capable position so as to be put in the ejection incapable position, the communication between the outlet 18 of the extending flow path P2 and the communication hole 52*f* can be blocked. Therefore, with a simple operation of rotating the nozzle head 50 from the ejection capable position to the ejection incapable position, a liquid can be prevented from being accidentally ejected when the trigger 41 is operated unexpectedly. Further, it is not necessary to operate a member that may cause attachment of liquid as in the case where the ejection hole 51*c* is closed by a lid body or the like when not used. Thus attachment of a liquid to a finger or the like can be prevented when the trigger-type ejector 1 is put into a liquid ejection incapable state.

Figure 4:
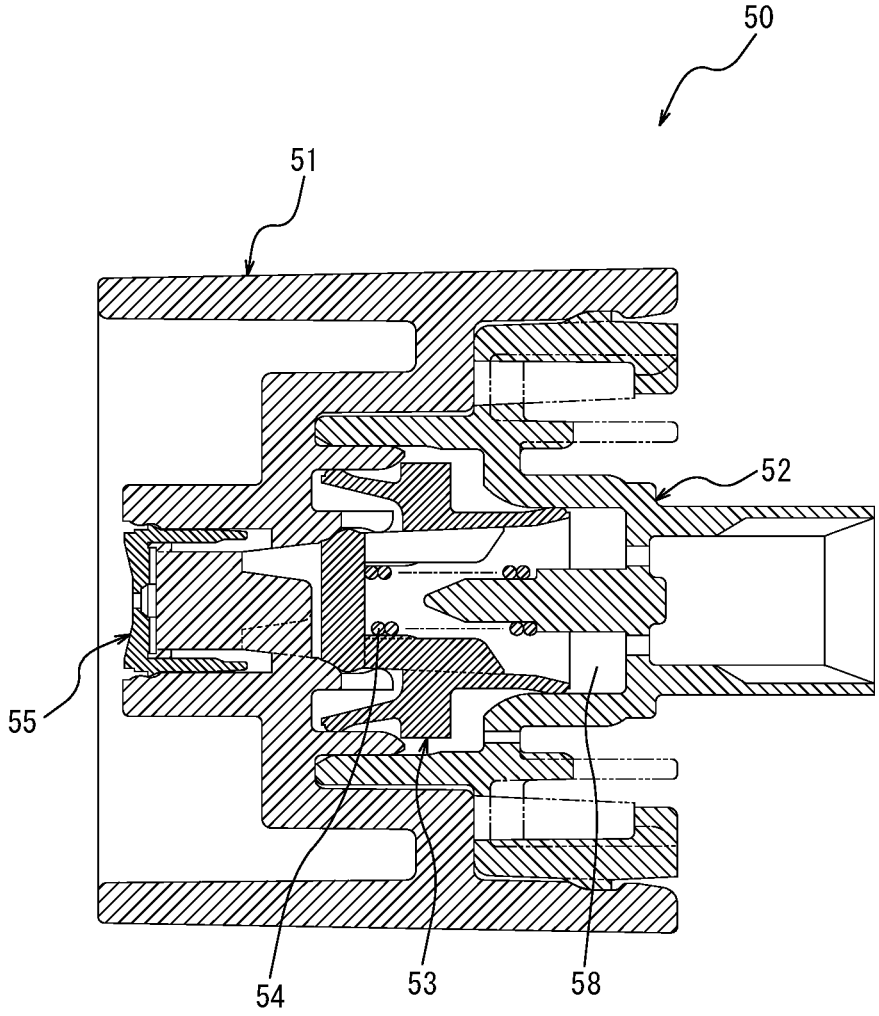
FIG. 4 is a cross-sectional diagram illustrating the nozzle head alone in FIG. 1.

In the nozzle head 50 configured in the above described manner, the first nozzle body 51 and the second nozzle body 52 are assembled such that the pressure storage plunger 53 and the biasing member 54 are sandwiched therebetween and are fixed to each other. Thus, as illustrated in FIG. 4, the nozzle head 50 can be configured as one unit in which the pressure storage plunger 53 and the biasing member 54 are disposed in the pressure storage chamber 58 defined and formed between the first nozzle body 51 and the second nozzle body 52. Further, when the nozzle head 50 is configured such that the nozzle chip 55 is attached to the tip thereof, the nozzle head 50 including the nozzle chip 55 can be provided as one unit. Therefore, the nozzle head 50 can be unitized (modularized) in advance in a separate process from an assembly process in which the pump 30 is assembled to the ejector body 10. Further, the nozzle head 50 unitized in the above described manner is pushed toward the ejector body 10 so that the inner cylinder wall 52*b* of the second nozzle body 52 is fitted into the column 20 provided at the ejector body 10 and the small-diameter cylinder portion 52*c* is fitted to the annular wall 19 to allow the locking flange 52*g* to be engaged with the outward claw 22 provided at the annular wall 19. Thus the nozzle head 50 can be easily assembled to the ejector body 10 without causing drop of the pressure storage plunger 53 and the biasing member 54.

Figure 5:
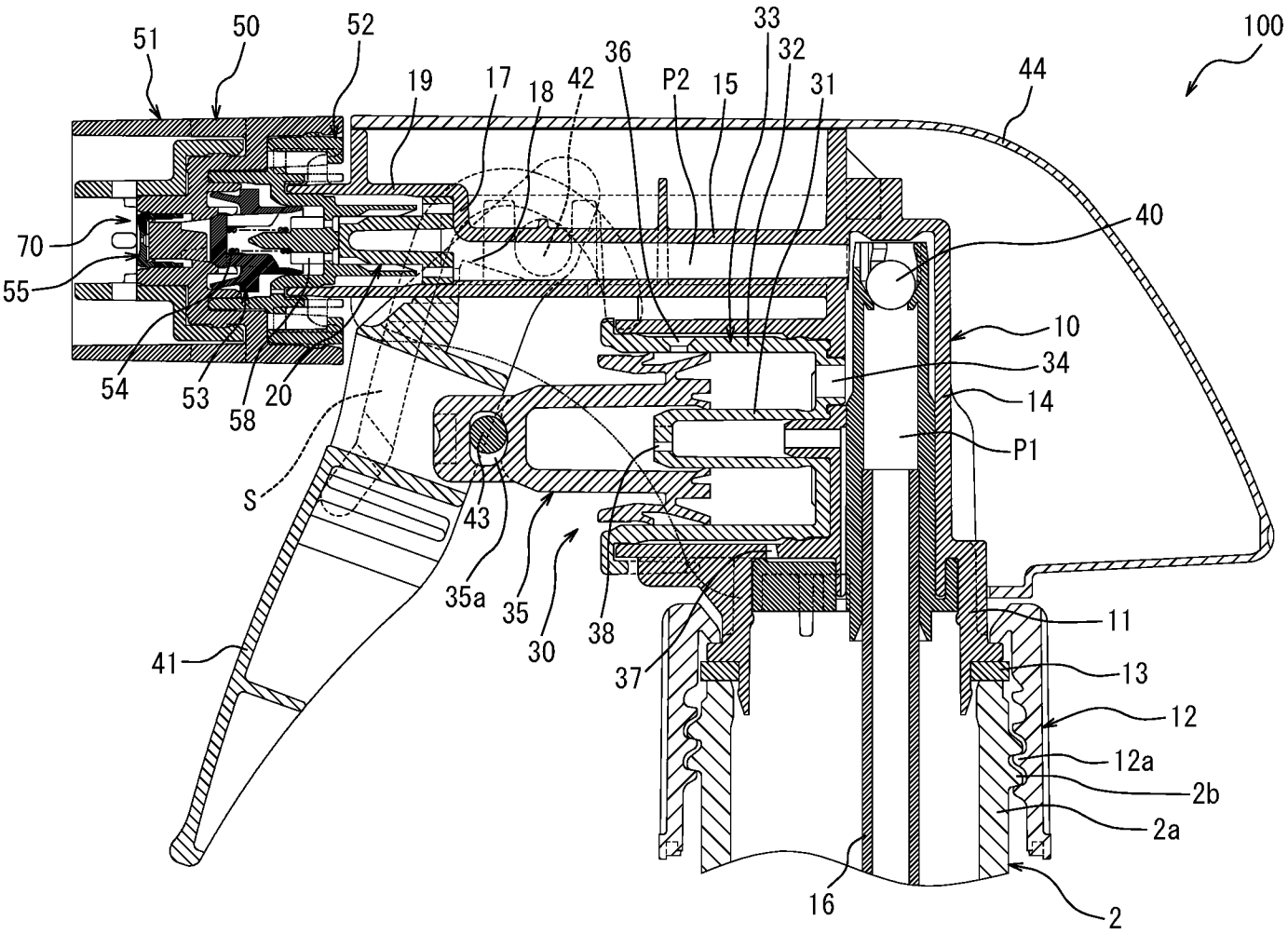
FIG. 5 is a cross-sectional diagram (longitudinal cross-sectional diagram) of a trigger-type ejector viewed from a side according to another embodiment of the present disclosure.
Figure 6:
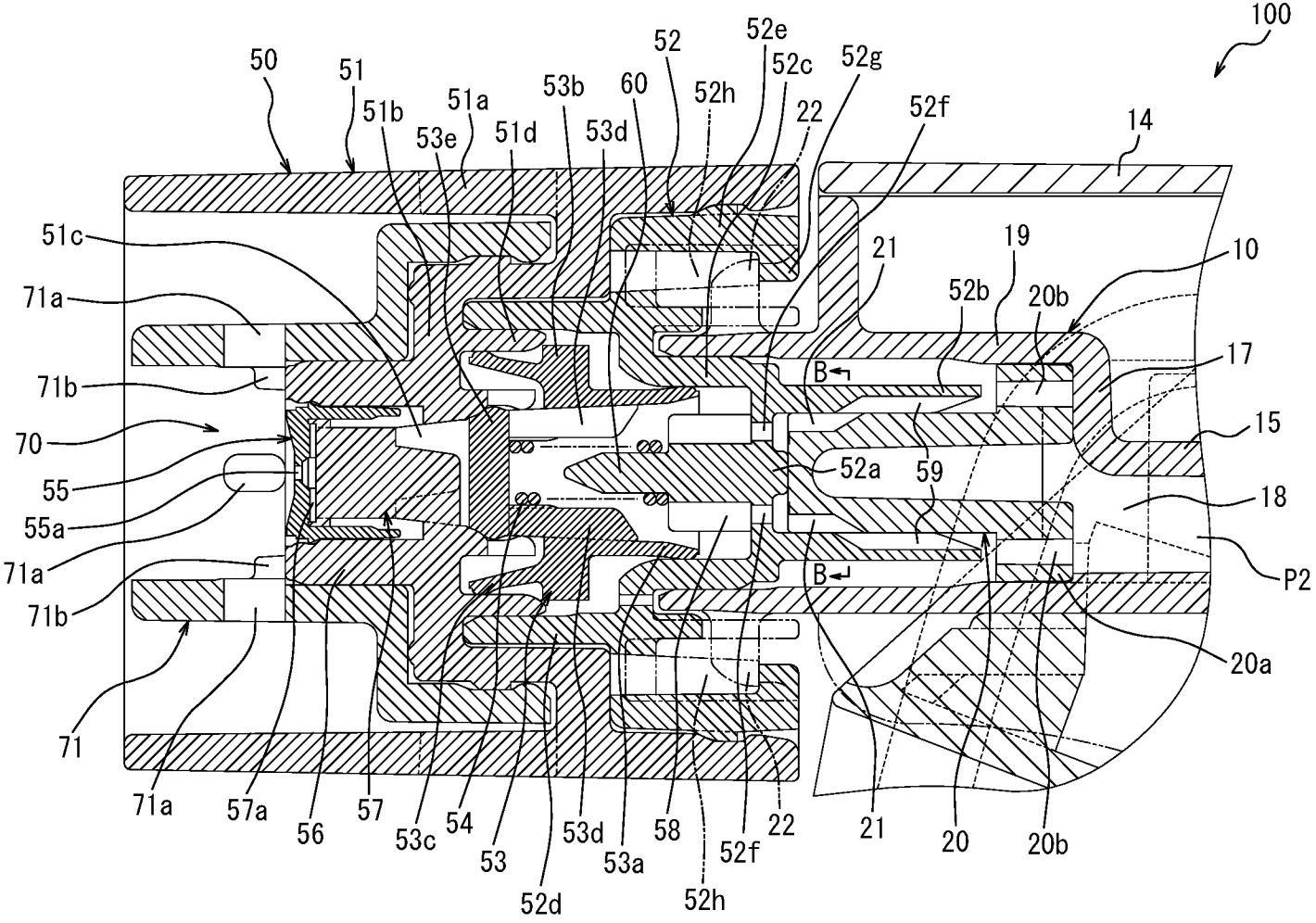
FIG. 6 is an enlarged cross-sectional diagram of a nozzle head of the trigger-type ejector illustrated in FIG. 5.
Figure 7A:
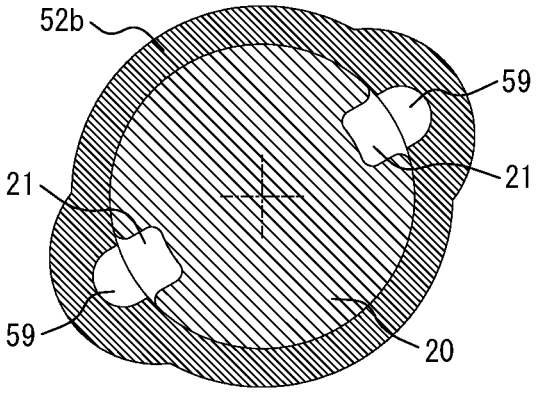
FIG. 7A is a cross-sectional diagram along B-B line in FIG. 6.
Figure 7B:
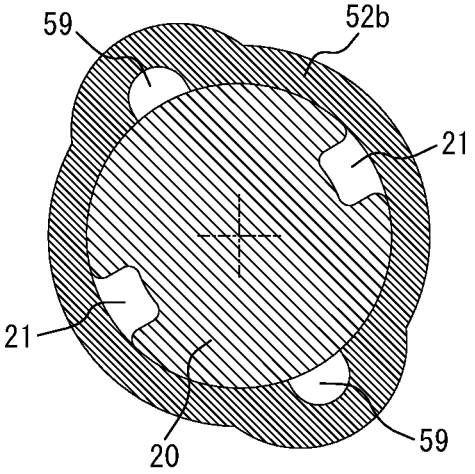
FIG. 7B is a cross-sectional diagram illustrating a state where the nozzle head is rotated from a state illustrated in FIG. 7A.
Figure 8:
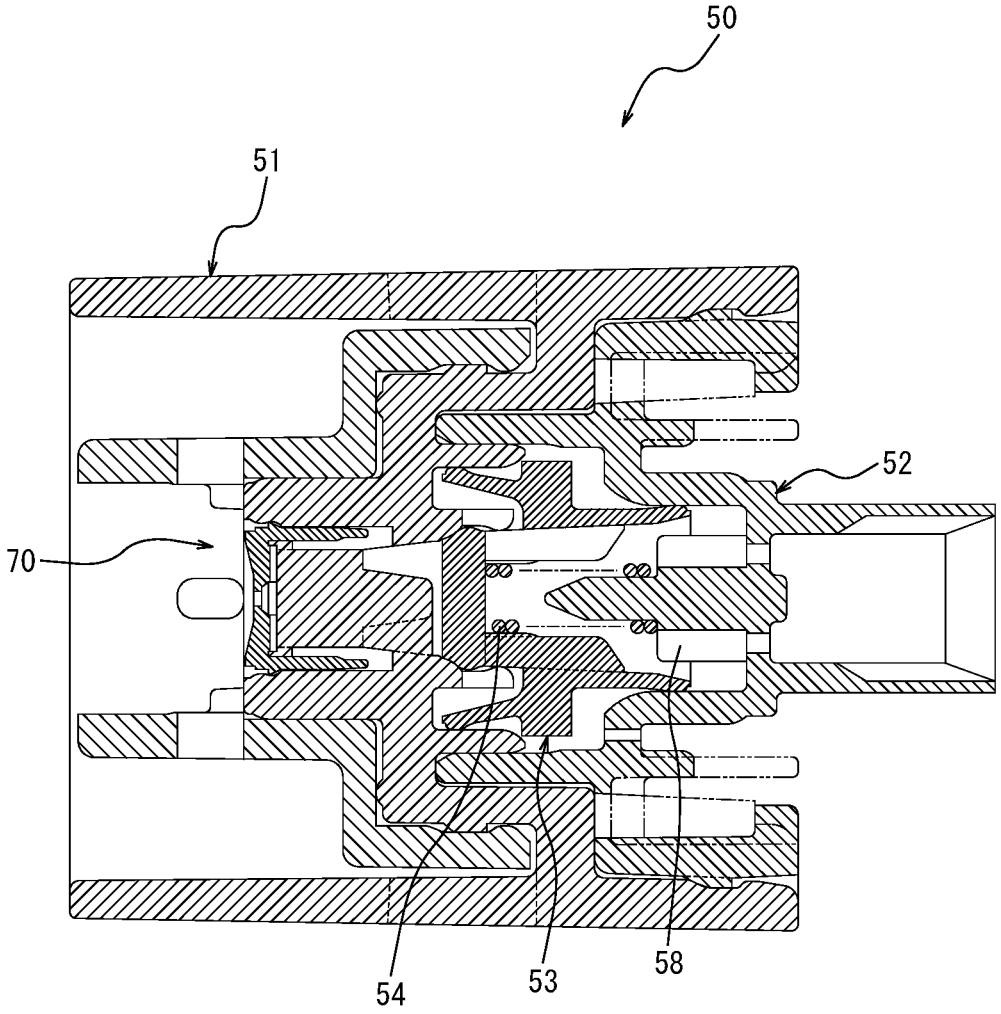
FIG. 8 is a cross-sectional diagram illustrating the nozzle head alone in FIG. 5.

FIG. 5 is a cross-sectional diagram (longitudinal cross-sectional diagram) of a trigger-type ejector viewed from a side according to another embodiment of the present disclosure, FIG. 6 is an enlarged cross-sectional diagram of a nozzle head of the trigger-type ejector illustrated in FIG. 5, FIG. 7A is a cross-sectional diagram along B-B line in FIG. 6, FIG. 7B is a cross-sectional diagram illustrating a state where a nozzle head is rotated from the state illustrated in FIG. 7A, and FIG. 8 is a cross-sectional diagram illustrating the nozzle head in FIG. 5 alone. It is to be noted that the members corresponding to the above described members are assigned with the same reference signs.

In a trigger-type ejector 100 according to another embodiment illustrated in FIGS. 5 to 8, the nozzle head 50 is provided with a foaming portion 70.

The foaming portion 70 is provided at the ejection hole 51*c*, and is configured to foam a liquid ejected from the ejection hole 51*c* and to eject the liquid to the outside. The foaming portion 70 has the nozzle chip 55 attached to the opening end of the projection cylinder 56, the spin element 57 provided inside the nozzle chip 55 and a cover tube 71 fixed to the first nozzle body 51 such that it covers the outside of the partition wall 51*b*.

The cover tube 71 is coaxial with the projection cylinder 56, extends forward of the projection cylinder 56 and has four (only three of them are illustrated in FIG. 6) air introduction holes 71*a* opened toward the tip of the projection cylinder 56. Further, in order to allow for easy assembly of the cover tube 71 to the projection cylinder 56, four projections 71*b* positioned between the air introduction holes 71*a* adjacent to each other and projected inward so as to be in abutment with the tip of the projection cylinder 56 are integrally provided on the inner periphery of the cover tube 71.

When an atomized liquid is ejected from the small hole 55*a* of the nozzle chip 55 at high pressure, a negative pressure occurs inside the cover tube 71, and the air is introduced from the outside of the cover tube 71 into the cover tube 71 through the air introduction hole 71*a*. Then, when the introduced air is mixed with the atomized high-pressure liquid, the liquid is foamed. Thus, the liquid ejected in the form of a mist from the ejection hole 51*c* is foamed by the foaming portion 70 and ejected to the outside.

Thus, even in the trigger-type ejector 100 whose nozzle head 50 is provided with the foaming portion 70, it is possible that the nozzle head 50 can be configured in one unit in which the pressure storage plunger 53 and the biasing member 54 are disposed in the pressure storage chamber 58 defined and formed between the first nozzle body 51 and the second nozzle body 52 and the foaming portion 70 is provided at the tip.

Needless to say, the present disclosure is not limited to the above described embodiments, and may be altered in various manners in the scope of claims.

For example, in the above described embodiments, although the cylinder 33 constituting the pump 30 is provided separately from the ejector body 10, it may be integrally provided with the ejector body 10. Further, configuration of the pump 30 itself may be altered in various manners.

Further, in the above described embodiments, although the nozzle head 50 is provided rotatably relative to the ejector body 10 between the ejection capable position and the ejection incapable position, it is also possible that the nozzle head 50 is fixed to the ejector body 10 so as not to allow the trigger-type ejector 1 to switch to the ejection incapable state.

Moreover, the number of the air introduction holes 71*a* provided at the cover tube 71 is not limited to four, and it may be changed in various manners.

REFERENCE SIGNS LIST

1 Trigger-type ejector
2 Container
2*a* Mouth
2*b* External thread
10 Ejector body
11 Coupling tube
12 Mounting cap
12*a* Internal thread
13 Sealing member
14 Standing portion
15 Extending portion
16 Tube
17 Plate wall
18 Outlet
19 Annular wall
20 Column
20*a* Large-diameter base end
20*b* Through hole
21 Front groove
22 Outward claw
30 Pump
31 Inner cylinder
32 Outer cylinder
33 Cylinder
34 Inflow/outflow hole
35 Piston
35*a* Recess
36 Air intake hole
37 Air vent hole
38 Opening
40 Check valve
41 Trigger
42 Pivot
43 Pin member
44 Shroud
50 Nozzle head
51 First nozzle body
51*a* Outer shell wall
51*b* Partition wall
51*c* Ejection hole
51*d* Large-diameter cylinder portion
52 Second nozzle body
52*a* Base
52*b* Inner cylinder wall
52*c* Small-diameter cylinder portion
52*d* Seal cylinder portion
52*e* Fixed cylinder portion
52*f* Communication hole
52*g* Locking flange
52*h* Stopper piece
53 Pressure storage plunger
53*a* Guide cylinder portion
53*b* Body
53*c* Large-diameter pressure receiving portion
53*d* Leg
53*e* Valve body (small-diameter pressure receiving portion)
54 Biasing member
55 Nozzle chip
55*a* Small hole
56 Projection cylinder
57 Spin element
57*a* Spin groove
58 Pressure storage chamber
59 Rear groove
60 Rod
70 Foaming portion
71 Cover tube
71*a* Air introduction hole
100 Trigger-type ejector
P1 Standing flow path
P2 Extending flow path
S Plate spring

The invention claimed is:

1. A trigger-type ejector comprising:

an ejector body attached to a mouth of a container in which a liquid is contained and including a flow path of a liquid;

a pump actuated by operation of a trigger and pumping the liquid in the container to the flow path; and a nozzle head attached to the ejector body by being continuous with an outlet of the flow path and ejecting a liquid pumped to the flow path from an ejection hole to an outside, the trigger-type ejector including:

a pressure storage chamber defined and formed in the nozzle head and communicating with the flow path through a communication hole;

a pressure storage plunger including a large-diameter pressure receiving portion and a small-diameter pressure receiving portion facing an opposite side to the large-diameter pressure receiving portion, the pressure storage plunger being disposed in the pressure storage chamber and being movable between a close position where the ejection hole is closed and an open position where the ejection hole is opened; and a biasing member disposed in the pressure storage chamber and biasing the pressure storage plunger toward the close position, wherein, when a pressure of a liquid in the pressure storage chamber becomes equal to or greater than a predetermined value, the pressure storage plunger moves from the close position to the open position against a biasing force of the biasing member such that the liquid in the pressure storage chamber is ejected from the ejection hole to an outside, the nozzle head includes a first nozzle body including the ejection hole and a second nozzle body fixed to the first nozzle body, defining and forming the pressure storage chamber with the first nozzle body, and including the communication hole, and is attached to the ejector body at the second nozzle body, the second nozzle body includes an inner cylinder wall surrounding the communication hole and including, in an inner periphery, at least one rear groove that communicates with the outlet of the flow path, the ejector body includes a column disposed inside the inner cylinder wall rotatably and liquid-tightly relative to the inner cylinder wall and is provided with, in an outer periphery, at least one front groove that communicates with the communication hole, and the nozzle head is rotatable relative to the ejector body between an ejection capable position where the rear groove and the front groove communicate with each other and an ejection incapable position where a communication between the rear groove and the front groove is blocked.

2. A trigger-type ejector comprising:

an ejector body attached to a mouth of a container in which a liquid is contained and including a flow path of a liquid;

a pump actuated by operation of a trigger and pumping the liquid in the container to the flow path; and a nozzle head attached to the ejector body by being continuous with an outlet of the flow path and ejecting a liquid pumped to the flow path from an ejection hole to an outside, the trigger-type ejector including:

a pressure storage chamber defined and formed in the nozzle head and communicating with the flow path through a communication hole;

a pressure storage plunger including a large-diameter pressure receiving portion and a small-diameter pressure receiving portion facing an opposite side to the large-diameter pressure receiving portion, the pressure storage plunger being disposed in the pressure storage chamber and being movable between a close position where the ejection hole is closed and an open position where the ejection hole is opened; and a biasing member disposed in the pressure storage chamber and biasing the pressure storage plunger toward the close position, wherein, when a pressure of a liquid in the pressure storage chamber becomes equal to or greater than a predetermined value, the pressure storage plunger moves from the close position to the open position against a biasing force of the biasing member such that the liquid in the pressure storage chamber is ejected from the ejection hole to an outside, and wherein the trigger-type ejector further comprises a foaming portion provided in the ejection hole and foaming a liquid ejected from the ejection hole, the nozzle head includes an inner cylinder wall surrounding the communication hole and including, in the inner periphery, at least one rear groove that communicates with the outlet of the flow path, and the ejector body includes a column disposed inside the inner cylinder wall rotatably and liquid-tightly relative to the inner cylinder wall and provided with, in an outer periphery, at least one front groove that communicates with the communication hole, thus the nozzle head is rotatable relative to the ejector body between an ejection capable position where the rear groove and the front groove communicate with each other and an ejection incapable position where communication between the rear groove and the front groove is blocked.

3. A trigger-type ejector comprising:

an ejector body attached to a mouth of a container in which a liquid is contained and including a flow path of a liquid;

a pump actuated by operation of a trigger and pumping the liquid in the container to the flow path; and a nozzle head attached to the ejector body by being continuous with an outlet of the flow path and ejecting a liquid pumped to the flow path from an ejection hole to an outside, the trigger-type ejector including:

a pressure storage chamber defined and formed in the nozzle head and communicating with the flow path through a communication hole;

a pressure storage plunger including a large-diameter pressure receiving portion and a small-diameter pressure receiving portion facing an opposite side to the large-diameter pressure receiving portion, the pressure storage plunger being disposed in the pressure storage chamber and being movable between a close position where the ejection hole is closed and an open position where the ejection hole is opened; and a biasing member disposed in the pressure storage chamber and biasing the pressure storage plunger toward the close position, wherein, when a pressure of a liquid in the pressure storage chamber becomes equal to or greater than a predetermined value, the pressure storage plunger moves from the close position to the open position against a biasing force of the biasing member such that the liquid in the pressure storage chamber is ejected from the ejection hole to an outside, the nozzle head includes a first nozzle body including the ejection hole and a second nozzle body fixed to the first nozzle body, defining and forming the pressure storage chamber with the first nozzle body, and including the communication hole, and is attached to the ejector body at the second nozzle body, wherein the ejector further includes a nozzle chip, wherein the nozzle chip is provided with a small hole whose opening cross-sectional area is smaller than that of the ejection hole and is attached to the ejection hole so as to atomize a liquid ejected from the ejection hole, the second nozzle body includes an inner cylinder wall surrounding the communication hole and including, in an inner periphery, at least one rear groove that communicates with the outlet of the flow path, the ejector body includes a column disposed inside the inner cylinder wall rotatably and liquid-tightly relative to the inner cylinder wall and is provided with, in an outer periphery, at least one front groove that communicates with the communication hole, and the nozzle head is rotatable relative to the ejector body between an ejection capable position where the rear groove and the front groove communicate with each other and an ejection incapable position where a communication between the rear groove and the front groove is blocked.

4. The trigger-type ejector according to claim 1, wherein, the trigger-type ejector further comprises a foaming portion provided in the ejection hole and foaming a liquid ejected from the ejection hole;

the nozzle head includes an inner cylinder wall surrounding the communication hole and including, in the inner periphery, at least one rear groove that communicates with the outlet of the flow path; and the ejector body includes a column disposed inside the inner cylinder wall rotatably and liquid-tightly relative to the inner cylinder wall and provided with, in an outer periphery, at least one front groove that communicates with the communication hole, thus the nozzle head is rotatable relative to the ejector body between an ejection capable position where the rear groove and the front groove communicate with each other and an ejection incapable position where communication between the rear groove and the front groove is blocked.

5. The trigger-type ejector according to claim 3, wherein, the trigger-type ejector further comprises a foaming portion provided in the ejection hole and foaming a liquid ejected from the ejection hole;

the nozzle head includes an inner cylinder wall surrounding the communication hole and including, in the inner periphery, at least one rear groove that communicates with the outlet of the flow path; and the ejector body includes a column disposed inside the inner cylinder wall rotatably and liquid-tightly relative to the inner cylinder wall and provided with, in an outer periphery, at least one front groove that communicates with the communication hole, thus the nozzle head is rotatable relative to the ejector body between an ejection capable position where the rear groove and the front groove communicate with each other and an ejection incapable position where communication between the rear groove and the front groove is blocked.

* * * * *